United States Patent [19]

Klimpel et al.

[11] Patent Number: 5,015,367

[45] Date of Patent: May 14, 1991

[54] ALKYLATED DIARYL OXIDE MONOSULFONATE COLLECTORS USEFUL IN THE FLOATATION OF MINERALS

[75] Inventors: Richard R. Klimpel, Midland; Donald E. Leonard, Shepherd, both of Mich.

[73] Assignee: The Dow Chemical Company, Midland, Mich.

[21] Appl. No.: 484,038

[22] Filed: Feb. 23, 1990

[51] Int. Cl.[5] ..... B03D 1/012; B03D 1/02

[52] U.S. Cl. ..... 209/166; 252/61; 162/7; 162/8

[58] Field of Search ..... 209/166, 167; 252/61; 162/5, 7, 8

[56] References Cited

U.S. PATENT DOCUMENTS

| | | | |
|---|---|---|---|
| 1,102,874 | 7/1914 | Chapman | 209/166 |
| 2,285,394 | 6/1942 | Cake | 209/166 |
| 4,081,363 | 3/1978 | Grayson | 209/166 |
| 4,110,207 | 8/1978 | Wang et al. | 209/166 |
| 4,139,482 | 2/1979 | Holme | 252/61 |
| 4,158,623 | 6/1979 | Wang et al. | 209/166 |
| 4,172,029 | 10/1979 | Hefner | 209/166 |
| 4,231,841 | 11/1980 | Calmanti | 162/8 |
| 4,308,133 | 12/1981 | Meyer | 209/166 |
| 4,486,301 | 12/1984 | Hsieh | 209/166 |
| 4,507,198 | 3/1985 | Unger et al. | 209/166 |

OTHER PUBLICATIONS

"Mineral and Coal Flotation Curcuits" by Lynch, Johnson Manlapig and Thorn, Advisory Editor-EUERSTENAU Elsevier Scienfitic Pub. Co. © 1981 pp. 13-15 and pp. 225-234.

"Characterization of Pyrite from Coal Source" Esposito et al. Publsihed in Process Minerology VII, 1987.

"*Flotation*" vol. 2-Fuerstenau Editor Pub. by AIM-Mind PE New York 1976.

"Comparative Study of the Surface Properties and the Reactivities of Coal Pyrite and Mineral Pyrite" by Lai et al.-Society of Mining Engrs. 3/89.

"An Electrochemical Characterization of Pyrite from Coal and Ore Sources" by Briceno et al.-Int'l. Journal of Mineral Processing 1987.

*Primary Examiner*—Stanley Silverman
*Assistant Examiner*—Thomas M. Lithgow
*Attorney, Agent, or Firm*—Paula Sanders Ruhr

[57] ABSTRACT

Alkylated diaryl oxide monosulfonic acids or salts thereof or their mixture are useful as collectors in the flotation of minerals, particularly oxide minerals.

18 Claims, No Drawings

ALKYLATED DIARYL OXIDE MONOSULFONATE COLLECTORS USEFUL IN THE FLOATATION OF MINERALS

CROSS-REFERENCE TO RELATED APPLICATION

This case is related to co-pending application, Ser. No. 336,143, filed Apr. 11, 1989, now abandoned, which is a continuation-in-part of co-pending application, Ser. No. 310,272, filed Feb. 13, 1989, now abandoned.

BACKGROUND OF THE INVENTION

This invention is related to the recovery of minerals by froth flotation.

Flotation is a process of treating a mixture of finely divided mineral solids, e.g., a pulverulent ore, suspended in a liquid whereby a portion of the solids is separated from other finely divided mineral solids, e.g., silica, siliceous gangue, clays and other like materials present in the ore, by introducing a gas (or providing a gas in situ) in the liquid to produce a frothy mass containing certain of the solids on the top of the liquid, and leaving suspended (unfrothed) other solid components of the ore. Flotation is based on the principle that introducing a gas into a liquid containing solid particles of different materials suspended therein causes adherence of some gas to certain suspended solids and not to others and makes the particles having the gas thus adhered thereto lighter than the liquid. Accordingly, these particles rise to the top of the liquid to form a froth.

The minerals and their associated gangue which are treated by froth flotation generally do not possess sufficient hydrophobicity or hydrophilicity to allow adequate separation. Therefore, various chemical reagents are often employed in froth flotation to create or enhance the properties necessary to allow separation. Collectors are used to enhance the hydrophobicity and thus the floatability of different mineral values. Collectors must have the ability to (1) attach to the desired mineral species to the relative exclusion of other species present; (2) maintain the attachment in the turbulence or shear associated with froth flotation; and (3) render the desired mineral species sufficiently hydrophobic to permit the required degree of separation.

A number of other chemical reagents are used in addition to collectors. Examples of types of additional reagents used include frothers, depressants, pH regulators, such as lime and soda, dispersants and various promoters and activators. Depressants are used to increase or enhance the hydrophilicity of various mineral species and thus depress their flotation. Frothers are reagents added to flotation systems to promote the creation of a semi-stable froth. Unlike both depressants and collectors, frothers need not attach or adsorb on mineral particles.

Froth flotation has been extensively practiced in the mining industry since at least the early twentieth century. A wide variety of compounds are taught to be useful as collectors, frothers and other reagents in froth flotation. For example, xanthates, simple alkylamines, alkyl sulfates, alkyl sulfonates, carboxylic acids and fatty acids are generally accepted as useful collectors. Reagents useful as frothers include lower molecular weight alcohols such as methyl isobutyl carbinol and glycol ethers. The specific additives used in a particular flotation operation are selected according to the nature of the ore, the conditions under which the flotation will take place, the mineral sought to be recovered and the other additives which are to be used in combination therewith.

While a wide variety of chemical reagents are recognized by those skilled in the art as having utility in froth flotation, it is also recognized that the effectiveness of known reagents varies greatly depending on the particular ore or ores being subjected to flotation as well as the flotation conditions. It is further recognized that selectivity or the ability to selectively float the desired species to the exclusion of undesired species is a particular problem.

Minerals and their associated ores are generally categorized as sulfides or oxides, with the latter group comprising oxygen-containing species such as carbonates, hydroxides, sulfates and silicates. Thus, the group of minerals categorized as oxides generally include any oxygen-containing mineral. While a large proportion of the minerals existing today are contained in oxide ores, the bulk of successful froth flotation systems is directed to sulfide ores. The flotation of oxide minerals is recognized as being substantially more difficult than the flotation of sulfide minerals and the effectiveness of most flotation processes in the recovery of oxide ores is limited.

A major problem associated with the recovery of both oxide and sulfide minerals is selectivity. Some of the recognized collectors such as the carboxylic acids, alkyl sulfates and alkyl sulfonates discussed above are taught to be effective collectors for oxide mineral ores. However, while the use of these collectors can result in acceptable recoveries, it is recognized that the selectivity to the desired mineral value is typically quite poor. That is, the grade or the percentage of the desired component contained in the recovered mineral is unacceptably low.

Due to the low grade of oxide mineral recovery obtained using conventional, direct flotation, the mining industry has generally turned to more complicated methods in an attempt to obtain acceptable recovery of acceptable grade minerals. Oxide ores are often subjected to a sulfidization step prior to conventional flotation in existing commercial processes. After the oxide minerals are sulfidized, they are then subjected to flotation using known sulfide collectors. Even with the sulfidization step, recoveries and grade are less than desirable. An alternate approach to the recovery of oxide ores is liquid/liquid extraction. A third approach used in the recovery of oxide ores, particularly iron oxides and phosphates, is reverse or indirect flotation. In reverse flotation, the flotation of the ore having the desired mineral values is depressed and the gangue or other contaminant is floated. In some cases, the contaminant is a mineral which may have value. A fourth approach to mineral recovery involves chemical dissolution or leaching.

None of these existing methods of flotation directed to oxide ores are without problems. Generally, known methods result in low recovery or low grade or both. The low grade of the minerals recovered is recognized as a particular problem in oxide mineral flotation. Known recovery methods have not been economically feasible and consequently, a large proportion of oxide ores simply are not processed. Thus, the need for improved selectivity in oxide mineral flotation is generally acknowledged by those skilled in the art of froth flotation.

SUMMARY OF THE INVENTION

The present invention is a process for the recovery of minerals by froth flotation comprising subjecting an aqueous slurry comprising particulate minerals to froth flotation in the presence of a collector comprising diaryl oxide sulfonic acids or salts thereof or mixtures of such salts or acids wherein monosulfonated species comprise at least about 20 weight percent of the sulfonated acids or salts under conditions such that the minerals to be recovered are floated. The recovered minerals may be the mineral that is desired or may be undesired contaminants. Additionally, the froth flotation process of this invention utilizes frothers and other flotation reagents known in the art.

The practice of the flotation process of this invention results in improvements in selectivity and thus the grade of minerals recovered from oxide and/or sulfide ores while generally maintaining or increasing overall recovery levels of the desired mineral. It is surprising that the use of alkylated diphenyl oxide monosulfonic acids or salts thereof results in consistent improvements in selectivity or recovery of mineral values.

DETAILED DESCRIPTION OF ILLUSTRATIVE EMBODIMENTS

The flotation process of this invention is useful in the recovery of mineral values from a variety of ores, including oxide ores as well as sulfide ores and mixed ores. The oxide or oxygen-containing minerals which may be treated by the practice of this invention include carbonates, sulfates, hydroxides and silicates as well as oxides.

Non-limiting examples of oxide ores which may be floated using the practice of this invention preferably include iron oxides, nickel oxides, copper oxides, phosphorus oxides, aluminum oxides and titanium oxides. Other types of oxygen-containing minerals which may be floated using the practice of this invention include carbonates such as calcite or dolomite and hydroxides such as bauxite.

Non-limiting examples of specific oxide ores which may be collected by froth flotation using the process of this invention include those containing cassiterite, hematite, cuprite, vallerite, calcite, talc, kaolin, apatite, dolomite, bauxite, spinel, corundum, laterite, azurite, rutile, magnetite, columbite, ilmenite, smithsonite, anglesite, scheelite, chromite, cerrusite, pyrolusite, malachite, chrysocolla, zincite, massicot, bixbyite, anatase, brookite, tungstite, uraninite, gummite, brucite, manganite, psilomelane, goethite, limonite, chrysoberyl, microlite, tantalite, topaz and samarskite. One skilled in the art will recognize that the froth flotation process of this invention will be useful for the processing of additional ores including oxide ores, wherein oxide is defined to include carbonates, hydroxides, sulfates and silicates as well as oxides.

The process of this invention is also useful in the flotation of sulfide ores. Non-limiting examples of sulfide ores which may be floated by the process of this invention include those containing chalcopyrite, chalcocite, galena, pyrite, sphalerite, molybdenite and pentlandite.

Noble metals such as gold and silver and the platinum group metals wherein platinum group metals comprise platinum, ruthenium, rhodium, palladium, osmium, and iridium, may also be recovered by the practice of this invention. For example, such metals are sometimes found associated with oxide and/or sulfide ores. Platinum, for example, may be found associated with troilite. By the practice of the present invention, such metals may be recovered in good yield.

Ores do not always exist purely as oxide ores or as sulfide ores. Ores occurring in nature may comprise both sulfur-containing and oxygen-containing minerals as well as small amounts of noble metals as discussed above. Minerals may be recovered from these mixed ores by the practice of this invention. This may be done in a two-stage flotation where one stage comprises conventional sulfide flotation to recover primarily sulfide minerals and the other stage of the flotation utilizes the process and collector composition of the present invention to recover primarily oxide minerals and any noble metals that may be present. Alternatively, both the sulfur-containing and oxygen-containing minerals may be recovered simultaneously by the practice of this invention.

A particular feature of the process of this invention is the ability to differentially float various minerals. Without wishing to be bound by theory, it is thought that the susceptibility of various minerals to flotation in the process of this invention is related to the crystal structure of the minerals. More specifically, a correlation appears to exist between the ratio of crystal edge lengths to crystal surface area on a unit area basis. Minerals having higher ratios appear to float preferentially when compared to minerals having lower ratios. Thus, minerals whose crystal structure has 24 or more faces (Group I) are generally more likely to float than minerals having 16 to 24 faces (Group II). Group III minerals comprising minerals having 12 to 16 faces are next in order of preferentially floating followed by Group IV minerals having 8 to 12 faces.

In the process of this invention, generally Group I minerals will float before Group II minerals which will float before Group III minerals which will float before Group IV minerals. By floating before or preferentially floating, it is meant that the preferred species will float at lower collector dosages. That is, a Group I mineral may be collected at a very low dosage. Upon increasing the dosage and/or the removal of most of the Group I mineral, a Group II mineral will be collected and so on.

One skilled in the art will recognize that these groupings are not absolute. Various minerals may have different possible crystal structures. Further the size of crystals existing in nature also varies which will influence the ease with which different minerals may be floated. An additional factor affecting flotation preference is the degree of liberation. Further, within a group, that is, among minerals whose crystals have similar edge length to surface area ratios, these factors and others will influence which member of the group floats first.

One skilled in the art can readily determine which group a mineral belongs to by examining standard mineralogy characterization of different minerals. These are available, for example, in *Manual of Mineralogy, 19th Edition,* Cornelius S. Hurlbut, Jr. and Cornelis Klein (John Wiley and Sons, New York 1977). Non-limiting examples of minerals in Group I include graphite, niccolite, covellite, molybdenite and beryl.

Non-limiting examples of minerals in Group II include rutile, pyrolusite, cassiterite, anatase, calomel, torbernite, autunite, marialite, meionite, apophyllite, zircon and xenotime.

Non-limiting examples of minerals in Group III include arsenic, greenockite, millerite, zincite, corundum, hematite, brucite, calcite, magnesite, siderite, rhodochrosite, smithsonite, soda niter, apatite, pyromorphite, mimetite and vanadinite.

Non-limiting examples of minerals in Group IV include sulfur, chalcocite, chalcopyrite, stibnite, bismuthinite, loellingite, marcasite, massicot, brookite, boehmite, diaspore, goethite, samarskite, atacamite, aragonite, witherite, strontianite, cerussite, phosgenite, niter, thenardite, barite, celestite, anglesite, anhydrite, epsomite, antlerite, caledonite, triphylite, lithiophilite, heterosite, purpurite, variscite, strengite, chrysoberyl, scorodite, descloizite, mottramite, brazilianite, olivenite, libethenite, adamite, phosphuranylite, childrenite, eosphorite, scheelite, powellite, wulfenite, topaz, columbite and tantalite.

As discussed above, these groupings are theorized to be useful in identifying which minerals will be preferentially floated. However, as discussed above, the collector and process of this invention are useful in the flotation of various minerals which do not fit into the above categories. These groupings are useful in predicting which minerals will float at the lowest relative collector dosage, not in determining which minerals may be collected by flotation in the process of this invention.

The selectivity demonstrated by the collectors of this invention permit the separation of small amounts of undesired minerals from the desired minerals. For example, the presence of apatite is frequently a problem in the flotation of iron as is the presence of topaz in the flotation of cassiterite. Thus, the collectors of the present invention are, in some cases, useful in reverse flotation where the undesired mineral is floated such as floating topaz away from cassiterite or apatite from iron.

In addition to the flotation of ores found in nature, the flotation process and collector composition of this invention are useful in the flotation of minerals from other sources. One such example is the waste materials from various processes such as heavy media separation, magnetic separation, metal working and petroleum processing. These waste materials often contain minerals that may be recovered using the flotation process of the present invention. Another example is the recovery of a mixture of graphite ink and other carbon based inks in the recycling of paper. Typically such recycled papers are de-inked to separate the inks from the paper fibers by a flotation process. The flotation process of the present invention is particularly effective in such de-inking flotation processes.

The diaryl oxide monosulfonic acid or monosulfonate collector of this invention corresponds to the general formula Ar'—O—Ar wherein Ar' and Ar are independently in each occurrence substituted or unsubstituted aromatic moieties such as, for example, phenyl or naphthyl with the proviso that one and only one of Ar' and Ar contain one sulfonic acid or sulfonic acid salt moiety. Preferably, the diaryl oxide monosulfonic acid or monosulfonate collector is an alkylated diphenyl oxide or an alkylated biphenyl phenyl oxide monosulfonic acid or monosulfonate or mixture thereof. The diaryl oxide monosulfonic acid or monosulfonate is preferably substituted with one or more hydrocarbyl substituents. The hydrocarbyl substituents may be substituted or unsubstituted alkyl or substituted or unsubstituted unsaturated alkyl.

The monosulfonated diaryl oxide collector of this invention is more preferably a diphenyl oxide collector and corresponds to the following formula or to a mixture of compounds corresponding to the formula:

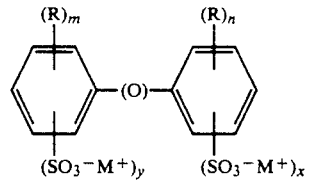

(I)

wherein each R is independently a saturated alkyl or substituted saturated alkyl radical or an unsaturated alkyl or substituted unsaturated alkyl radical: each m and n is independently 0, 1 or 2; each M is independently hydrogen, an alkali metal, alkaline earth metal, or ammonium or substituted ammonium and each x and y are individually 0 or 1 with the proviso that the sum of x and y is one. Preferably, the R group(s) is independently an alkyl group having from about 1 to about 24, more preferably from about 6 to about 24 carbon atoms, even more preferably about 6 to about 16 carbon atoms and most preferably about 10 to about 16 carbon atoms. The alkyl groups can be linear, branched or cyclic with linear or branched radicals being preferred. It is also preferred that m and n are each one. The $M^+$ ammonium ion radicals are of the formula $(R')_3HN^+$ wherein each R' is independently hydrogen, a $C_1$–$C_4$ alkyl or a $C_1$–$C_4$ hydroxyalkyl radical. Illustrative $C_1$–$C_4$ alkyl and hydroxyalkyl radicals include methyl, ethyl, propyl, isopropyl, butyl, hydroxymethyl and hydroxyethyl. Typical ammonium ion radicals include ammonium ($N^+H_4$), methylammonium ($CH_3N^+H_3$), ethylammonium ($C_2H_5N^+H_3$), dimethylammonium ($(CH_3)_2N^+H_2$), methylethylammonium ($CH_3N^+H_2C_2H_5$), trimethylammonium ($(CH_3)_3N^+H$), dimethylbutylammonium ($(CH_3)_2N^+HC_4H_9$), hydroxyethylammonium ($HOCH_2CH_2N^+H_3$) and methylhydroxyethylammonium ($CH_3N^+H_2CH_2CH_2OH$). Preferably, each M is hydrogen, sodium, calcium, potassium or ammonium.

Alkylated diphenyl oxide sulfonates and their methods of preparation are well-known and reference is made thereto for the purposes of this invention. The monosulfonate collectors of the present invention may be prepared by modifications to known methods of preparation of sulfonates. Representative methods of preparation of sulfonates are disclosed in U.S. Pat. Nos. 3,264,242; 3,634,272; and 3,945,437 (all of which are hereby incorporated by reference). Commercial methods of preparation of the alkylated diphenyl oxide sulfonates generally do not produce species which are exclusively monoalkylated, monosulfonated, dialkylated or disulfonated. The commercially available species are predominantly (greater than 90 percent) disulfonated and are a mixture of mono- and dialkylated with the percentage of dialkylation being about 15 to about 25 and the percentage of monoalkylation being about 75 to 85 percent. Most typically, the commercially available species are about 80 percent monoalkylated and 20 percent dialkylated In the practice of this invention, the use of monosulfonated species has been found to be critical. Such monosulfonated species may be prepared by a modification of the sulfonation step in the methods described in, for example, U.S. Pat. Nos. 3,264,242: 3,634,272; and 3,945,437. Specifically, the methods taught above are directed to preparing predominantly disulfonated species. Thus, in the sulfonation step, it is taught to use sufficient sulfonating agent to sulfonate both aromatic rings. However, in the preparation of the monosulfonates useful in the practice of the present invention, the amount of sulfonating agent used is preferably limited to that needed to provide one sulfonate group per molecule.

The monosulfonates prepared in this way will include both molecules which are not sulfonated as well as those which contain more than one sulfonate group per molecule. If desired, the monosulfonates may be separated and used in relatively pure form. However, the mixture resulting from a sulfonation step utilizing only sufficient sulfonating agent to provide approximately one sulfonate group per molecule is also useful in the practice of this invention.

As stated above, the use of monosulfonated species is critical to the practice of this invention. However, the presence of disulfonated species is not thought to be detrimental from a theoretical standpoint as long as at least about 20 percent of the monosulfonated species is present. It is preferred that at least about 25 percent monosulfonation is present and more preferred that at least about 40 percent monosulfonation is present and most preferred that at least about 50 percent monosulfonation is present. It is most preferred to use relatively pure monosulfonated acids or salts. In commercial applications, one skilled in the art will recognize that whatever higher costs are associated with the production of the relatively pure monosulfonated species will be balanced against decreases in effectiveness associated with the use of mixtures containing disulfonated species.

Commercially available alkylated diphenyl oxide sulfonates frequently are mixtures of monoalkylated and dialkylated species. While such mixtures of monoalkylated and dialkylated species are operable in the practice of this invention, it is preferable in some circumstances to use species that are either monoalkylated, dialkylated or trialkylated. Such species are prepared by modifications of the methods described in, for example, U.S. Pat. Nos. 3,264,242: 3,634,272: and 3,945,437. When it is desired to use other than a mixture, a distillation step is inserted after alkylation to remove monoalkylated species and either use the monoalkylated species or recycle it for further alkylation. Generally, it is preferred to use dialkylated species although monoalkylated and trialkylated are operable.

Non-limiting examples of preferred alkylated diphenyl oxide sulfonates include sodium monosulfonated diphenyl oxide, sodium monosulfonated hexyldiphenyl oxide, sodium monosulfonated decyldiphenyl oxide, sodium monosulfonated dodecyldiphenyl oxide, sodium monosulfonated hexadecyldiphenyl oxide, sodium monosulfonated eicosyldiphenyl oxide and mixtures thereof. In a more preferred embodiment, the collector is a sodium monosulfonated dialkylated diphenyl oxide wherein the alkyl group is a $C_{10-16}$ alkyl group, most preferably a $C_{10-12}$ alkyl group. The alkyl groups may be branched or linear.

The collector can be used in any concentration which gives the desired selectivity and recovery of the desired mineral values. In particular, the concentration used is dependent upon the particular mineral to be recovered, the grade of the ore to be subjected to the froth flotation process and the desired quality of the mineral to be recovered.

Additional factors to be considered in determining dosage levels include the amount of surface area of the ore to be treated. As will be recognized by one skilled in the art, the smaller the particle size, the greater the surface area of the ore and the greater the amount of collector reagents needed to obtain adequate recoveries and grades. Typically, oxide mineral ores must be ground finer than sulfide ores and thus require very high collector dosages or the removal of the finest particles by desliming. Conventional processes for the flotation of oxide minerals typically require a desliming step to remove the fines present and thus permit the process to function with acceptable collector dosage levels. The collector of the present invention functions at acceptable dosage levels with or without desliming.

Preferably, the concentration of the collector is at least about 0.001 kg/metric ton, more preferably at least about 0.05 kg/metric ton. It is also preferred that the total concentration of the collector is no greater than about 5.0 kg/metric ton and more preferred that it is no greater than about 2.5 kg/metric ton. In general, to obtain optimum performance from the collector, it is most advantageous to begin at low dosage levels and increase the dosage level until the desired effect is achieved. While the increases in recovery and grade obtained by the practice of this invention increase with increasing dosage, it will be recognized by those skilled in the art that at some point the increase in recovery and grade obtained by higher dosage is offset by the increased cost of the flotation chemicals. It will also be recognized by those skilled in the art that varying collector dosages are required depending on the type of ore and other conditions of flotation. Additionally, the collector dosage required has been found to be related to the amount of mineral to be collected. In those situations where a small amount of a mineral susceptible to flotation using the process of this invention, a very low collector dosage is needed due to the selectivity of the collector.

It has been found advantageous in the recovery of certain minerals to add the collector to the flotation system in stages. By staged addition, it is meant that a part of the collector dose is added; froth concentrate is collected: an additional portion of the collector is added; and froth concentrate is again collected. The total amount of collector used is preferably not changed when it is added in stages. This staged addition can be repeated several times to obtain optimum recovery and grade. The number of stages in which the collector is added is limited only by practical and economic constraints. Preferably, no more than about six stages are used.

An additional advantage of staged addition is related to the ability of the collector of the present invention to differentially float different minerals at different dosage levels. As discussed above, at low dosage levels, one mineral particularly susceptible to flotation by the collector of this invention is floated while other minerals remain in the slurry. At an increased dosage, a different mineral may be floated thus permitting the separation of different minerals contained in a given ore.

In addition to the collector of this invention, other conventional reagents or additives may be used in the flotation process. Examples of such additives include various depressants and dispersants well-known to those skilled in the art. Additionally, the use of hydroxy-containing compounds such as alkanol amines or alkylene glycols has been found to useful in improving the selectivity to the desired mineral values in systems containing silica or siliceous gangue. The collector of this invention may also be used in conjunction with other collectors. In addition, frothers may be and typically are used. Frothers are well known in the art and reference is made thereto for the purposes of this invention. Examples of useful frothers include polyglycol ethers and lower molecular weight frothing alcohols.

A particular advantage of the collector of the present invention is that additional additives are not required to adjust the pH of the flotation slurry. The flotation process utilizing the collector of the present invention operates effectively at typical natural ore pH's ranging from about 5 or lower to about 9. This is particularly important when considering the cost of reagents needed to adjust slurry pH from a natural pH of around 7.0 or lower to 9.0 or 10.0 or above which is typically necessary using conventional carboxylic, sulfonic, phosphonic and xanthic collectors.

The ability of the collector of the present invention to function at relatively low pH means that it may also be used in those instances where it is desired to lower the slurry pH. The lower limit on the slurry pH at which the present invention is operable is that pH at which the surface charge on the mineral species is suitable for attachment by the collector.

Since the collector of the present invention functions at different pH levels, it is possible to take advantage of the tendency of different minerals to float at different pH levels. This makes it possible to do one flotation run at one pH to optimize flotation of a particular species. The pH can then be adjusted for a subsequent run to optimize flotation of a different species thus facilitating separation of various minerals found together.

The collector of this invention may also be used in conjunction with conventional collectors. For example, the monosulfonated diaryl oxide collectors of this invention may be used in a two-stage flotation in which the monosulfonated diaryl oxide flotation recovers primarily oxide minerals while a second stage flotation using conventional collectors is used to recover primarily sulfide minerals or additional oxide minerals. When used in conjunction with conventional collectors, a two-stage flotation may be used wherein the first stage comprises the process of this invention and is done at the natural pH of the slurry. The second stage involves conventional collectors and is conducted at an elevated pH. It should be noted that in some circumstances, it may be desirable to reverse the stages. Such a two-stage process has the advantages of using less additives to adjust pH and also permits a more complete recovery of the desired minerals by conducting flotation under different conditions.

The following examples are provided to illustrate the invention and should not be interpreted as limiting it in any way. Unless stated otherwise, all parts and percentages are by weight.

The following examples include work involving Hallimond tube flotation and flotation done in laboratory scale flotation cells. It should be noted that Hallimond tube flotation is a simple way to screen collectors, but does not necessarily predict the success of collectors in actual flotation. Hallimond tube flotation does not involve the shear or agitation present in actual flotation and does not measure the effect of frothers. Thus, while a collector must be effective in a Hallimond tube flotation if it is to be effective in actual flotation, a collector effective in Hallimond tube flotation will not necessarily be effective in actual flotation. It should also be noted that experience has shown that collector dosages required to obtain satisfactory recoveries in a Hallimond tube are often substantially higher than those required in a flotation cell test. Thus, the Hallimond tube work cannot precisely predict dosages that would be required in an actual flotation cell.

EXAMPLE 1

Hallimond Tube Floatation of Malachite and Silica

About 1.1 g of (1) malachite, a copper oxide mineral having the approximate formula $Cu_2CO_3(OH)_2$, or (2) silica is sized to about −60 to +120 U.S. mesh and placed in a small bottle with about 20 ml of deionized water. The mixture is shaken 30 seconds and then the water phase containing some suspended fine solids or slimes is decanted. This desliming step is repeated several times.

A 150-ml portion of deionized water is placed in a 250-ml glass beaker. Next, 2.0 ml of a 0.10 molar solution of potassium nitrate is added as a buffer electrolyte. The pH is adjusted to about 10.0 with the addition of 0.10 N HCl and/or 0.10 N NaOH. Next, a 1.0-g portion of the deslimed mineral is added along with deionized water to bring the total volume to about 180 ml. The collector, a branched $C_{16}$ alkylated sodium diphenyl oxide sulfonate comprising about 80 percent monoalkylated species and about 20 percent dialkylated species, is added and allowed to condition with stirring for 15 minutes. The pH is monitored and adjusted as necessary using HCl and NaOH. It should be noted that Runs 1–5 are not embodiments of the invention and use a disulfonated collector while Runs 6–10, which are embodiments of the invention, use a monosulfonated collector. The only difference in the collectors used in Runs 1–5 and those used in Runs 6–10 is disulfonated versus monosulfonation.

The slurry is transferred into a Hallimond tube designed to allow a hollow needle to be fitted at the base of the 180-ml tube. After the addition of the slurry to the Hallimond tube, a vacuum of 5 inches of mercury is applied to the opening of the tube for a period of 10 minutes. This vacuum allows air bubbles to enter the tube through the hollow needle inserted at the base of the tube. During flotation, the slurry is agitated with a magnetic stirrer set at 200 revolutions per minute (RPM).

The floated and unfloated material is filtered out of the slurry and oven dried at 100° C. Each portion is weighed and the fractional recoveries of copper and silica are reported in Table I below. After each test, all equipment is washed with concentrated HCl and rinsed with 0.10 N NaOH and deionized water before the next run.

The recovery of copper and silica, respectively, reported is that fractional portion of the original mineral placed in the Hallimond tube that is recovered. Thus, a recovery of 1.00 indicates that all of the material is recovered. It should be noted that although the recovery of copper and silica, respectively, is reported together, the data is actually collected in two experiments done under identical conditions. It should further be noted that a low silica recovery suggests a selectivity to the copper. The values given for copper recovery generally are correct to ±0.05 and those for silica recovery are generally correct to ±0.03.

TABLE I

| Run | Collector | Dosage (kg/kg) | pH | Fractional Cu Recovery | Fractional Silica Recovery |
|---|---|---|---|---|---|
| 1[2] | L-$C_{16}DPO(SO_3Na)_2$[1] | 0.060 | 5.5 | 0.760 | 0.153 |
| 2[2] | L-$C_{16}DPO(SO_3Na)_2$[1] | 0.060 | 7.0 | 0.809 | 0.082 |
| 3[2] | L-$C_{16}DPO(SO_3Na)_2$[1] | 0.060 | 8.5 | 0.800 | 0.062 |
| 4[2] | L-$C_{16}DPO(SO_3Na)_2$[1] | 0.060 | 10.0 | 0.546 | 0.104 |
| 5[2] | L-$C_{16}DPO(SO_3Na)_2$[1] | 0.060 | 11.5 | 0.541 | 0.130 |
| 6 | L-$C_{16}DPO(SO_3Na)_1$[3] | 0.060 | 5.5 | 0.954 | 0.135 |
| 7 | L-$C_{16}DPO(SO_3Na)_1$[3] | 0.060 | 7.0 | 0.968 | 0.097 |
| 8 | L-$C_{16}DPO(SO_3Na)_1$[3] | 0.060 | 8.5 | 0.913 | 0.084 |
| 9 | L-$C_{16}DPO(SO_3Na)_1$[3] | 0.060 | 10.0 | 0.837 | 0.070 |
| 10 | L-$C_{16}DPO(SO_3Na)_1$[3] | 0.060 | 11.5 | 0.798 | 0.065 |

[1]Linear $C_{16}$ alkylated sodium diphenyl oxide sulfonate comprising about 80 percent mono- and 20 percent dialkylated species available commercially from The Dow Chemical Company as DOWFAX TM 8390 brand surfactant.
[2]Not an embodiment of the invention.
[3]Linear $C_{16}$ alkylated sodium diphenyl oxide monosulfonate comprising about 80 percent mono- and 20 percent dialkylated species.

The data in Table I above clearly demonstrates the effectiveness of the present invention. A comparison of Runs 1–5, not embodiments of the invention, with Runs 6–10 shows that at various pH levels, the monosulfonated collector of the present invention consistently results in substantially higher copper recoveries and comparable or lower silica recoveries.

EXAMPLE 2

Flotation of Iron Oxide Ore

A series of 600-g samples of iron oxide ore from Michigan are prepared. The ore contains a mixture of hematite, martite, goethite and magnetite mineral species. Each 600-g sample is ground along with 400 g of deionized water in a rod mill at about 60 RPM for 10 minutes. The resulting pulp is transferred to an Agitair 3000 ml flotation cell outfitted with an automated paddle removal system. The collector is added and the slurry is allowed to condition for one minute. Next, an amount of a polyglycol ether frother equivalent to 40 g per ton of dry ore is added followed by another minute of conditioning.

The float cell is agitated at 900 RPM and air is introduced at a rate of 9.0 liters per minute. Samples of the froth concentrate are collected at 1.0 and 6.0 minutes after the start of the air flow. Samples of the froth concentrate and the tailings are dried, weighed and pulverized for analysis. They are then dissolved in acid, and the iron content determined by the use of a D.C. Plasma Spectrometer. Using the assay data, the fractional recoveries and grades are calculated using standard mass balance formulas. The results are shown in Table II below.

TABLE II

| Run | Collector | Dosage (kg/metric ton) | Iron Recovery and Grade: 0–1 Minute Rec | 0–1 Minute Gr | 1–6 Minutes Rec | 1–6 Minutes Gr | Total Rec | Total Gr |
|---|---|---|---|---|---|---|---|---|
| 1[1] | B,D-$C_{12}DPO(SO_3Na)_2$[2] | 0.200 | 0.494 | 0.462 | 0.106 | 0.394 | 0.600 | 0.450 |
| 2 | B,D-$C_{12}DPO(SO_3Na)_1$[3] | 0.200 | 0.677 | 0.487 | 0.240 | 0.401 | 0.907 | 0.464 |

[1]Not an embodiment of the invention.
[2]Branched $C_{12}$ dialkylated sodium diphenyl oxide disulfonate.
[3]Branched $C_{12}$ dialkylated sodium diphenyl oxide monosulfonate.

A comparison of Runs 1 and 2 demonstrates that the use of the monosulfonated collector of this invention results in approximately a 50 percent increase in recovery of a slightly higher grade iron that is obtained using a disulfonated collector.

EXAMPLE 3

Flotation of Rutile Ores

A series of 30-g samples of a −10 mesh (U.S.) mixture of 10 percent rutile ($TiO_2$) and 90 percent silica ($SiO_2$) are prepared. Each sample of ore is ground with 15 g of deionized water in a rod mill (2.5 inch diameter with 0.5 inch rods) for 240 revolutions. The resulting pulp is transferred to a 300 ml flotation cell.

The pH of the slurry is left at natural ore pH of 8.0. After addition of the collector as shown in Table III, the slurry is allowed to condition for one minute. Next, the frother, a polyglycol ether, is added in an amount equivalent to 0.050 kg per ton of dry ore and the slurry is allowed to condition an additional minute.

The float cell is agitated at 1800 RPM and air is introduced at a rate of 2.7 liters per minute. Samples of the froth concentrate are collected by standard hand paddling at 1.0 and 6.0 minutes after the start of the introduction of air into the cell. Samples of the concentrate and the tailings are dried and analyzed as described in the previous examples. The results obtained are presented in Table III below.

TABLE III

| Run | Collector | Dosage (kg/metric ton) | Rutile and Silica Mixture: Titanium Recovery and Grade: 0–1 Minute Rec | 0–1 Minute Gr | 1–6 Minutes Rec | 1–6 Minutes Gr | Total Rec | Total Gr |
|---|---|---|---|---|---|---|---|---|
| 1[1] | L,D-$C_{16}DPO(SO_3Na)_2$[2] | 0.200 | 0.677 | 0.086 | 0.061 | 0.064 | 0.738 | 0.084 |
| 2 | L,D-$C_{16}DPO(SO_3Na)_1$[3] | 0.100 | 0.763 | 0.110 | 0.151 | 0.074 | 0.914 | 0.104 |
| 3[1] | B,D-$C_{12}DPO(SO_3Na)_2$[4] | 0.200 | 0.756 | 0.099 | 0.086 | 0.075 | 0.842 | 0.097 |
| 4 | B,D-$C_{12}DPO(SO_3Na)_1$[5] | 0.200 | 0.809 | 0.077 | 0.134 | 0.066 | 0.943 | 0.075 |
| 5 | B,D-$C_{12}DPO(SO_3Na)_1$[5] | 0.100 | 0.714 | 0.086 | 0.117 | 0.070 | 0.831 | 0.084 |
| 6 | B,D-$C_{10}DPO(SO_3Na)_1$[6] | 0.100 | 0.674 | 0.095 | 0.099 | 0.071 | 0.773 | 0.092 |

[1]Not an embodiment of the invention.
[2]A linear $C_{16}$ dialkylated sodium diphenyl oxide disulfonate.
[3]A linear $C_{16}$ dialkylated sodium diphenyl oxide monosulfonate.
[4]A branched $C_{12}$ dialkylated sodium diphenyl oxide disulfonate.
[5]A branched $C_{12}$ dialkylated sodium diphenyl oxide monosulfonate.
[6]A branched $C_{10}$ dialkylated sodium diphenyl oxide monosulfonate.

The data in Table III above demonstrates the effect of the collector of the present invention in increasing titanium grade and recovery. Comparison of Run 1 with Run 2 and Runs 4 and 5 with Run 3 again shows the marked improvements obtained using the monosulfonate collectors of this invention as compared to disulfonate collectors.

EXAMPLE 4

Separation of Apatite and Silica

A series of 30-g samples of a −10 mesh (U.S.) mixture of 10 percent apatite ($Ca_5(Cl_1F)[PO_4]_3$) and 90 percent silica ($SiO_2$) are prepared. The remainder of the procedure is exactly the same as that used in Example 3. The natural ore slurry pH is 7.1. In Runs 8–13, a blend of monosulfonated and disulfonated collector is used. The data in Table IV shows the ability of the process of this invention to separate apatite and silica.

TABLE IV

| Run | Collector | Dosage (kg/metric ton) | P Recovery | P Grade |
|---|---|---|---|---|
| 1[1] | L,D-$C_{10}DPO(SO_3Na)_2$[2] | 0.050 | 0.115 | 0.081 |
| 2 | L,D-$C_{10}DPO(SO_3Na)_1$[3] | 0.050 | 0.962 | 0.068 |
| 3[1] | B,D-$C_{12}DPO(SO_3Na)_2$[4] | 0.050 | 0.235 | 0.078 |
| 4 | B,D-$C_{12}DPO(SO_3Na)_1$[5] | 0.050 | 0.989 | 0.067 |
| 5 | Refined kerosene[6] | 0.050 | | |
| | L,D-$C_{10}DPO(SO_3Na)_1$[3] | 0.050 | 0.925 | 0.103 |
| 6 | Refined kerosene[6] | 0.010 | | |
| | L,D-$C_{10}DPO(SO_3Na)_1$[3] | 0.050 | 0.862 | 0.112 |
| 7 | Refined kerosene[6] | 0.020 | | |
| | L,D-$C_{10}DPO(SO_3Na)_1$[3] | 0.050 | 0.818 | 0.125 |
| 8 | L,D-$C_{10}DPO(SO_3Na)_2$[2] | 0.040 | | |
| | L,D-$C_{10}DPO(SO_3Na)_1$[3] | 0.010 | 0.336 | 0.077 |
| 9 | L,D-$C_{10}DPO(SO_3Na)_2$[2] | 0.030 | | |
| | L,D-$C_{10}DPO(SO_3Na)_1$[3] | 0.020 | 0.529 | 0.075 |
| 10 | L,D-$C_{10}DPO(SO_3Na)_2$[2] | 0.020 | | |
| | L,D-$C_{10}DPO(SO_3Na)_1$[3] | 0.030 | 0.699 | 0.074 |
| 11 | L,D-$C_{10}DPO(SO_3Na)_2$[2] | 0.010 | | |
| | L,D-$C_{10}DPO(SO_3Na)_1$[3] | 0.040 | 0.866 | 0.069 |
| 12 | L,D-$C_{10}DPO(SO_3Na)_2$[2] | 0.080 | | |
| | L,D-$C_{10}DPO(SO_3Na)_1$[3] | 0.020 | 0.539 | 0.067 |
| 13 | L,D-$C_{10}DPO(SO_3Na)_2$[2] | 0.160 | | |
| | L,D-$C_{10}DPO(SO_3Na)_1$[3] | 0.040 | 0.877 | 0.053 |

[1]Not an embodiment of the invention.
[2]A linear $C_{10}$ dialkylated sodium diphenyl oxide disulfonate.
[3]A linear $C_{10}$ dialkylated sodium diphenyl oxide monosulfonate.
[4]A branched $C_{12}$ dialkylated sodium diphenyl oxide disulfonate.
[5]A branched $C_{12}$ dialkylated sodium diphenyl oxide monosulfonate.
[6]A refined kerosene product available commercially from Phillips Petroleum as Soltrol TM brand kerosene. It is added simultaneously with the collector to the flotation cell.

The information presented in Table IV demonstrates the marked effectiveness of the monosulfonated collectors in recovering phosphorus from an apatite and silica ore. Comparing Runs 2 and 4 to Runs 1 and 2, which are not examples of the invention, demonstrates the effect of monosulfonation. Runs 5–6 demonstrate that the collector of this invention is effective when used with an added hydrocarbon. A slight decrease in recovery is accompanied by a marked increase in grade. In Runs 8–13, the effect of mixing monosulfonated collectors and disulfonated collectors is demonstrated. A comparison of Runs 2, 11 and 13, wherein the levels of monosulfonated collectors are comparable and the amount of disulfonated species ranges from zero to 0.160 kg per metric ton, shows that the presence of the disulfonated species at low levels appears to act as a diluent. At higher levels, the disulfonated species does not interfere with recovery, but does appear to lower grade.

EXAMPLE 5

Samples (30 g of −10 mesh [U.S.]) of ore from Central Africa are prepared. The content of the copper metal in the ore is about 90 percent malachite with the remainder being other minerals of copper. Each sample of ore is ground along with 15 grams of deionized water in a mini-rod mill (2.5 inch diameter with 0.5 inch rods) for 1200 revolutions. The resulting pulp is transferred to a 300-ml mini-flotation cell. The pH of the slurry is left at a natural ore pH of 6.2. Collector is added at a dosage of 0.250 kg per metric ton of dry ore feed in Runs 1–20. In Runs 20–26, the collector dosage is varied and in Runs 22–26, the collector includes varying amounts of a disulfonate. After addition of the collector, the slurry is allowed to condition in the cell for one minute. Frother, a polyglycol ether, is added next at a dosage of 0.080 kg per metric ton of dry ore. This addition is followed by another minute of conditioning.

The float cell is agitated for 1800 RPM and air is introduced at a rate of 2.7 liters per minute. The froth concentrate is collected for 6.0 minutes. The samples of concentrates and tailing are then dried, weighed, pulverized for analysis and then dissolved with the use of acid. The copper content is determined by use of a D.C. plasma spectrometer.

TABLE V

| Run | Collector | Dosage (kg/metric ton) | pH | Cu Recovery | Cu Grade |
|---|---|---|---|---|---|
| 1[1] | None | — | 6.2 | 0.038 | 0.019 |
| 2 | B,D-$C_{12}DPO(SO_3Na)_1$[2] | 0.250 | 6.2 | 0.696 | 0.057 |
| 3[1] | B,D-$C_{12}DPO(SO_3Na)_2$[3] | 0.250 | 6.2 | 0.501 | 0.042 |
| 4 | L,D-$C_{10}DPO(SO_3Na)_1$[4] | 0.250 | 6.2 | 0.674 | 0.056 |
| 5[1] | L,D-$C_{10}DPO(SO_3Na)_2$5 | 0.250 | 6.2 | 0.487 | 0.035 |
| 6 | L,D-$C_{10}BIPPE(SO_3Na)_1$[6] | 0.250 | 6.2 | 0.696 | 0.059 |
| 7[1] | L,D-$C_{10}BIPPE(SO_3Na)_2$[7] | 0.250 | 6.2 | 0.573 | 0.051 |
| 8 | L,D-$C_{16}DPO(SO_3Na)_1$[8] | 0.250 | 6.2 | 0.714 | 0.058 |
| 9[1] | L,D-$C_{16}DPO(SO_3Na)_2$[9] | 0.250 | 6.2 | 0.598 | 0.052 |
| 10 | L,M-$C_{10}DPO(SO_3Na)_1$[10] | 0.250 | 6.2 | 0.390 | 0.046 |
| 11[1] | L,M-$C_{10}DPO(SO_3Na)_2$[11] | 0.250 | 6.2 | 0.116 | 0.038 |
| 12 | B,M-$C_{12}DPO(SO_3Na)_1$[12] | 0.250 | 6.2 | 0.338 | 0.044 |
| 13[1] | B,M-$C_{12}DPO(SO_3Na)_2$[13] | 0.250 | 6.2 | 0.145 | 0.041 |
| 14 | L,M-$C_{24}DPO(SO_3Na)_1$[14] | 0.250 | 6.2 | 0.474 | 0.037 |
| 15[1] | L,M-$C_{24}DPO(SO_3Na)_2$[15] | 0.250 | 6.2 | 0.335 | 0.035 |
| 16 | L,M-$C_6DPO(SO_3Na)_1$[16] | 0.250 | 6.2 | 0.111 | 0.037 |
| 17[1] | L,M-$C_6DPO(SO_3Na)_2$[17] | 0.250 | 6.2 | 0.053 | 0.038 |
| 18 | L,D-$C_6DPO(SO_3Na)_1$[18] | 0.250 | 6.2 | 0.317 | 0.041 |
| 19[1] | L,D-$C_6DPO(SO_3Na)_2$[19] | 0.250 | 6.2 | 0.198 | 0.038 |
| 20 | B,D-$C_{12}DPO(SO_3Na)_1$[2] | 0.400 | 6.2 | 0.839 | 0.055 |
| 21[1] | B,D-$C_{12}DPO(SO_3Na)_2$[3] | 0.400 | 6.2 | 0.533 | 0.039 |
| 22 | B,D-$C_{12}DPO(SO_3Na)_1$[2] | 0.100 | 6.2 | 0.620 | 0.045 |
| | B,D-$C_{12}DPO(SO_3Na)_2$[3] | 0.300 | | | |
| 23 | B,D-$C_{12}DPO(SO_3Na)_1$[2] | 0.200 | 6.2 | 0.683 | 0.051 |
| | B,D-$C_{12}DPO(SO_3Na)_2$[3] | 0.200 | | | |
| 24 | B,D-$C_{12}DPO(SO_3Na)_1$[2] | 0.300 | 6.2 | 0.788 | 0.054 |
| | B,D-$C_{12}DPO(SO_3Na)_2$[3] | 0.100 | | | |
| 25 | B,D-$C_{12}DPO(SO_3Na)_1$[2] | 0.400 | 6.2 | 0.855 | 0.041 |
| | B,D-$C_{12}DPO(SO_3Na)_2$[3] | 0.400 | | | |
| 26 | B,D-$C_{12}DPO(SO_3Na)_1$[2] | 0.400 | 6.2 | 0.861 | 0.039 |

TABLE V-continued

| Run | Collector | Dosage (kg/metric ton) | pH | Cu Recovery | Cu Grade |
|---|---|---|---|---|---|
| | B,D-$C_{12}$DPO($SO_3Na$)$_2$[3] | 1.200 | | | |

[1]Not an embodiment of the invention.
[2]Branched di $C_{12}$ alkylated sodium diphenyl oxide monosulfonate.
[3]Branched di $C_{12}$ alkylated sodium diphenyl oxide disulfonate.
[4]Linear di $C_{10}$ alkylated sodium diphenyl oxide monosulfonate.
[5]Linear di $C_{10}$ alkylated sodium diphenyl oxide disulfonate.
[6]Linear di $C_{10}$ alkylated biphenylphenylether monosulfonate.
[7]Linear di $C_{10}$ alkylated biphenylphenylether disulfonate.
[8]Linear di $C_{16}$ alkylated sodium diphenyl oxide monosulfonate.
[9]Linear di $C_{16}$ alkylated sodium diphenyl oxide disulfonate.
[10]Linear mono $C_{10}$ alkylated sodium diphenyl oxide monosulfonate.
[11]Linear mono $C_{10}$ alkylated sodium diphenyl oxide disulfonate.
[12]Branched mono $C_{12}$ alkylated sodium diphenyl oxide monosulfonate.
[13]Branched mono $C_{12}$ alkylated sodium diphenyl oxide disulfonate.
[14]Linear mono $C_{24}$ alkylated sodium diphenyl oxide monosulfonate.
[15]Linear mono $C_{24}$ alkylated sodium diphenyl oxide disulfonate.
[16]Linear mono $C_6$ alkylated sodium diphenyl oxide monosulfonate.
[17]Linear mono $C_6$ alkylated sodium diphenyl oxide disulfonate.
[18]Linear di $C_6$ alkylated sodium diphenyl oxide monosulfonate.
[19]Linear di $C_6$ alkylated sodium diphenyl oxide disulfonate.

The information in the above table demonstrates the effectiveness of various alkylated diaryl oxide monosulfonates in the flotation of copper oxide ores. A comparison of the even numbered Runs 2–18 which are examples of the invention with the odd numbered Runs 1–19 which are not examples clearly demonstrates the substantially improved results obtained when using a monosulfonated collector as compared to a disulfonated collector when used at the same dosage. Comparing Run 2 with Run 21 demonstrates the effect of dosage. Runs 20–26 show that in blends, the disulfonated species appears to act as a diluent when blended with the monosulfonated collectors of this invention.

EXAMPLE 6

Flotation of Iron Oxide Ore

A series of 600-g samples of iron oxide ore from Michigan are prepared. The ore contains a mixture of hematite, martite, goethite and magnetite mineral species. Each 600-g sample is ground along with 400 g of deionized water in a rod mill at about 60 RPM for 15 minutes. The resulting pulp is transferred to an Agitair 3000 ml flotation cell outfitted with an automated paddle removal system. Flotation is conducted at the natural slurry pH of 7.0. Propylene glycol is added in the amount specified in Table VI below and the slurry is allowed to condition for one minute. Next, the collector is added and the slurry is allowed to condition for one minute. Next, an amount of a polyglycol ether frother equivalent to 40 g per ton of dry ore is added followed by another minute of conditioning. After flotation is begun, additional collector is added in stages as shown in Table VI below.

The float cell is agitated at 900 RPM and air is introduced at a rate of 9.0 liters per minute. Samples of the froth concentrate are collected at intervals of zero to 1.0, 1.0 to 3.0, 3.0 to 4.0, 4.0 to 6.0, 6.0 to 7.0, 7.0 to 9.0, 9.0 to 10.0 and 10.0 to 14 0 minutes after the start of the air flow as shown in the table below. Samples of the froth concentrate and the tailings are dried, weighed and pulverized for analysis. They are then dissolved in acid, and the iron content determined by the use of a D.C. Plasma Spectrometer. Using the assay data, the fractional recoveries and grades are calculated using standard mass balance formulas. The results are shown in Table VI below.

TABLE VI

| Collector | Dosage (kg/metric ton) | Iron Recovery and Grade | | | | | |
|---|---|---|---|---|---|---|---|
| | | | | | | Cumulative Total | |
| | | Rec | Gr | Rec | Gr | Rec | Gr |
| | | 0–1 Minute | | 1–3 Minutes | | | |
| Propylene glycol | 0.100 | 0.112 | 0.514 | 0.028 | 0.461 | 0.140 | 0.503 |
| B,D-$C_{12}$DPO($SO_3Na$)$_2$[1 2] | 0.042 | | | | | | |
| | | 3–4 Minutes | | 4–6 Minutes | | | |
| B,D-$C_{12}$DPO($SO_3Na$)$_2$[1 2] | 0.042 | 0.231 | 0.538 | 0.061 | 0.550 | 0.432 | 0.528 |
| | | 6–7 Minutes | | 7–9 Minutes | | | |
| B,D-$C_{12}$DPO($SO_3Na$)$_2$[1 2] | 0.042 | 0.178 | 0.488 | 0.045 | 0.493 | 0.655 | 0.515 |
| | | 9–10 Minutes | | 10–14 Minutes | | | |
| B,D-$C_{12}$DPO($SO_3Na$)$_2$[1 2] | 0.042 | 0.094 | 0.366 | 0.096 | 0.284 | 0.845 | 0.472 |
| | | 0–1 Minute | | 1–3 Minutes | | | |
| Propylene glycol | 0.100 | 0.353 | 0.526 | 0.157 | 0.498 | 0.510 | 0.517 |
| B,D-$C_{12}$DPO($SO_3Na$)$_1$[3] | 0.042 | | | | | | |
| | | 3–4 Minutes | | 4–6 Minutes | | | |
| B,D-$C_{12}$DPO($SO_3Na$)$_1$[3] | 0.042 | 0.219 | 0.508 | 0.099 | 0.487 | 0.828 | 0.510 |

[1]Not an embodiment of the invention.
[2]A branched $C_{12}$ dialkylated sodium diphenyl oxide disulfonate.
[3]A branched $C_{12}$ dialkylated sodium diphenyl oxide monosulfonate.

The data in Table VI above demonstrates that the monosulfonate collector of the present invention results in a very high recovery of high grade iron in substantially less time than comparable recoveries using the disulfonate.

EXAMPLE 7

Flotation of Various Oxide Minerals

The general procedure of Example 1 is followed with the exception that various oxide minerals are used in place of the copper ore. All runs are conducted at a pH of 8.0. The collector used is a branched $C_{12}$ dialkylated sodium diphenyl oxide monosulfonate at a dosage of 0.024 kg of collector per kilogram of mineral.

TABLE VII

| Mineral | Fractional Mineral Recovery |
|---|---|
| Silica ($SiO_2$) | 0.204 |
| Cassiterite ($SnO_2$) | 0.931 |
| Bauxite [Al(OH)3] | 0.989 |
| Calcite ($CaCO_3$) | 0.957 |
| Chromite ($FeCr_2O_4$) | 1.000 |
| Dolomite [$CaMg(CO_3)_2$] | 0.968 |
| Malachite [$Cu_2CO_3(OH)_2$] | 0.989 |
| Chrysocolla [$Cu_2H_2Si_2O_5(OH)_4$] | 0.616 |

TABLE VII-continued

| Mineral | Fractional Mineral Recovery |
|---|---|
| Hematite ($Fe_2O_3$) | 0.971 |
| Corundum ($A_2O_3$) | 1.000 |
| Rutile ($TiO_2$) | 0.970 |
| Apatite [$Ca_5(Cl_1F)[PO_4]_3$] | 0.990 |
| Nickel Oxide (NiO) | 0.778 |
| Galena (PbS) | 0.990 |
| Chalcopyrite ($CuFeS_2$) | 0.991 |
| Chalcocite ($Cu_2S$) | 0.993 |
| Pyrite ($FeS_2$) | 1.000 |
| Sphalerite (ZnS) | 1.000 |
| Pentlandite [Ni(FeS)] | 0.980 |
| Elemental Cu[2] | 0.931 |
| Elemental Au[2] | 0.964 |
| Elemental Ag[2] | 0.873 |
| Barite ($BaSO_4$) | 0.968 |
| Molybdenite ($MoS_2$) | 0.968 |
| Cerussite ($PbCO_3$) | 0.939 |
| Calcite ($CaCO_3$) | 0.807 |
| Beryl ($Be_3Al_2Si_6O_{18}$) | 0.937 |
| Covellite (CuS) | 0.788 |
| Zircon ($ZrSiO_4$) | 0.876 |
| Graphite (C) | 0.937 |
| Topaz [$Al_2SiO_4(F_1OH)_2$] | 0.955 |
| Scheelite ($CaWO_4$) | 0.871 |
| Anatase ($TiO_2$) | 0.909 |
| Boehmite ($_\gamma$AlO.OH) | 0.886 |
| Diaspore ($\alpha$AlO.OH) | 0.905 |
| Goethite ($HFeO_2$) | 0.959 |

[1]Sample includes some pyrrhotite.
[2]Sample comprises powdered elemental metal of similar size to other mineral samples.

The data in Table VII demonstrates the broad range of minerals which may be floated using the collector and process of this invention.

EXAMPLE 8

Flotation of Mixed Copper Sulfide Ore Containing Molybdenum

A series of 30-gram samples of a −10 mesh (U.S.) ore from Arizona containing a mixture of various copper oxide minerals and copper sulfide minerals plus minor amounts of molybdenum minerals are prepared. The grade of copper in the ore is 0.013 and the grade of the molybdenum is 0.000016.

Each sample of ore is ground in a laboratory swing mill for 10 seconds and the resulting fines are transferred to a 300 ml flotation cell.

Each run is conducted at a natural ore slurry pH of 5.6. The collector is added at a dosage of 0.050 kg/ton of dry ore and the slurry is allowed to condition for one minute. Two concentrates are collected by standard hand paddling between zero and two minutes and two to six minutes. Just before flotation is initiated, a frother, a polyglycol ether available commercially from The Dow Chemical Company as Dowfroth® 250 brand frother, is added in an amount equivalent to 0.030 kg/ton of dry ore.

The float cell in all runs is agitated at 1800 RPM and air is introduced at a rate of 2.7 liters per minute. Samples of the concentrates and the tailings are then dried and analyzed as described in the previous examples. The results obtained are presented in Table VIII below.

TABLE VIII

| Collector | Dosage (kg/metric ton) | 0-2 Minutes Cu Rec | 0-2 Minutes Cu Rec | 0-2 Minutes Mo Rec | 0-2 Minutes Mo Grade | 2-6 Minutes Cu Rec | 2-6 Minutes Cu Grade | 2-6 Minutes Mo Rec | 2-6 Minutes Mo Grade |
|---|---|---|---|---|---|---|---|---|---|
| L,D-$C_{10}DPO(SO_3Na)_1$[1] | 0.050 | 0.820 | 0.169 | 0.875 | 0.000042 | 0.85 | 0.088 | 0.042 | .000011 |
| L,D-$C_{10}DPO(SO_3Na)_2$[2] | 0.050 | 0.447 | 0.133 | 0.706 | 0.000025 | 0.151 | 0.116 | 0.039 | .000005 |
| L,D-$C_{10}DPO(SO_3Na)_1$[1] | 0.025 | 0.533 | 0.148 | 0.771 | 0.000026 | 0.232 | 0.130 | 0.041 | .000003 |

| Collector | Dosage (kg/metric ton) | Cumulative Metal Recovery and Grade Cu Rec | Cu Grade | Mo Rec | Mo Grade |
|---|---|---|---|---|---|
| L,D-$C_{10}DPO(SO_3Na)_1$[1] | 0.050 | 0.905 | 0.161 | 0.917 | .000040 |
| L,D-$C_{10}DPO(SO_3Na)_2$[2] | 0.050 | 0.598 | 0.129 | 0.745 | .000024 |
| L,D-$C_{10}DPO(SO_3Na)_1$[1] | 0.025 | 0.765 | 0.143 | 0.812 | .000025 |

[1]Branched $C_{12}$ dialkylated sodium diphenyl oxide monosulfonate.
[2]Branched $C_{12}$ dialkylated sodium diphenyl oxide disulfonate.

The data in Table VIII above demonstrates that the monosulfonated collector of the present invention obtains significantly improved recoveries of higher grade copper and molybdenum than does a comparable disulfonated collector.

EXAMPLE 9

Hallimond Tube Flotation

The procedure outlined in Example 1 is followed using a number of different mineral species and various collectors. Metal assays are performed on flotation concentrates and flotation tailings using acid dissolution and D.C. plasma spectrometry. The results are shown in Table IX below. While the data is presented in a single table, it is important to note that data on each mineral is obtained individually. In each instance the flotations are conducted at the natural pH of the respective ores in slurry form, i.e., 5.8 for rutile; 6.7 for apatite: 6.0 for pyrolusite: and 6.8 for diaspore.

TABLE IX

| Run | Collector | Dosage (kg/kg) | Rutile Recovery | Apatite Recovery | Pyrolusite Recovery | Diaspore Recovery |
|---|---|---|---|---|---|---|
| 1 | B,D-$C_{12}DPO(SO_3Na)_1$[1] | 0.0001 | 0.021 | 0.009 | — | — |
| 2 | B,D-$C_{12}DPO(SO_3Na)_1$[1] | 0.0005 | 0.323 | 0.038 | — | — |
| 3 | B,D- | 0.0010 | 0.713 | 0.463 | — | — |

TABLE IX-continued

| Run | Collector | Dosage (kg/kg) | Rutile Recovery | Apatite Recovery | Pyrolusite Recovery | Diaspore Recovery |
|---|---|---|---|---|---|---|
| 4 | $C_{12}DPO(SO_3Na)_1$[1] B,D- | 0.0100 | 0.954 | 0.856 | 0.745 | 0.598 |
| 5[2] | $C_{12}DPO(SO_3Na)_1$[1] B,D- | 0.0001 | 0.000 | 0.000 | — | — |
| 6[2] | $C_{12}DPO(SO_3Na)_2$[3] B,D- | 0.0005 | 0.015 | 0.007 | — | — |
| 7[2] | $C_{12}DPO(SO_3Na)_2$[3] B,D- | 0.0010 | 0.087 | 0.297 | — | — |
| 8[2] | $C_{12}DPO(SO_3Na)_2$[3] B,D- | 0.0100 | 0.175 | 0.518 | 0.314 | 0.280 |
| 9[2] | $C_{12}DPO(SO_3Na)_2$[3] B,D- | 0.0500 | 0.371 | — | — | — |
| 10[2] | $C_{12}DPO(SO_3Na)_2$[3] B,D- | 0.1000 | 0.815 | 0.849 | — | — |
| 11 | $C_{12}DPO(SO_3Na)_2$[3] B,M- | 0.0001 | 0.000 | 0.000 | — | — |
| 12 | $C_{12}DPO(SO_3Na)_1$[4] B,M- | 0.0005 | 0.011 | 0.000 | — | — |
| 13 | $C_{12}DPO(SO_3Na)_1$[4] B,M- | 0.0010 | 0.034 | 0.111 | — | — |
| 14 | $C_{12}DPO(SO_3Na)_1$[4] B,M- | 0.0100 | 0.129 | 0.277 | 0.289 | 0.166 |
| 15 | $C_{12}DPO(SO_3Na)_1$[4] B,M- | 0.0500 | 0.296 | — | — | — |
| 16 | $C_{12}DPO(SO_3Na)_1$[4] B,M- | 0.1000 | 0.644 | 0.680 | — | — |
| 17[2] | $C_{12}DPO(SO_3Na)_1$[4] B,M- | 0.0001 | 0.000 | 0.000 | — | — |
| 18[2] | $C_{12}DPO(SO_3Na)_2$[5] B,M- | 0.0005 | 0.000 | 0.000 | — | — |
| 19[2] | $C_{12}DPO(SO_3Na)_2$[5] B,M- | 0.0010 | 0.000 | 0.000 | — | — |
| 20[2] | $C_{12}DPO(SO_3Na)_2$[5] B,M- | 0.0100 | 0.009 | 0.011 | 0.017 | 0.005 |
| 21[2] | $C_{12}DPO(SO_3Na)_2$[5] B,M- | 0.0500 | 0.027 | — | — | — |
| 22[2] | $C_{12}DPO(SO_3Na)_2$[5] B,M- | 0.1000 | 0.065 | 0.081 | — | — |
| 23 | $C_{12}DPO(SO_3Na)_2$[5] L,D- | 0.0001 | 0.104 | — | — | — |
| 24 | $C_{10}DPO(SO_3Na)_1$[6] L,D- | 0.0003 | 0.310 | — | — | — |
| 25 | $C_{10}DPO(SO_3Na)_1$[6] L,D- | 0.0005 | 0.563 | — | — | — |
| 26 | $C_{10}DPO(SO_3Na)_1$[6] L,D- | 0.0010 | 0.869 | — | — | — |
| 27 | $C_{10}DPO(SO_3Na)_1$[6] L,D- | 0.0100 | — | 0.773 | 0.605 | — |
| 28 | $C_{10}DPO(SO_3Na)_1$[6] L,D- | 0.0200 | — | 0.956 | — | — |
| 29[2] | $C_{10}DPO(SO_3Na)_1$[6] L,D- | 0.0001 | 0.030 | — | — | — |
| 30[2] | $C_{10}DPO(SO_3Na)_2$[7] L,D- | 0.0003 | 0.041 | — | — | — |
| 31[2] | $C_{10}DPO(SO_3Na)_2$[7] L,D- | 0.0005 | 0.095 | — | — | — |
| 32[2] | $C_{10}DPO(SO_3Na)_2$[7] L,D- | 0.0010 | 0.164 | — | — | — |
| 33[2] | $C_{10}DPO(SO_3Na)_2$[7] L,D- | 0.0100 | — | 0.444 | 0.248 | — |
| 34[2] | $C_{10}DPO(SO_3Na)_2$[7] L,D- | 0.0200 | — | 0.581 | — | — |
| 35 | $C_{10}DPO(SO_3Na)_2$[7] L,M- | 0.0005 | 0.051 | — | — | — |
| 36 | $C_{10}DPO(SO_3Na)_1$[8] L,M- | 0.0010 | 0.120 | — | — | — |
| 37 | $C_{10}DPO(SO_3Na)_1$[8] L,M- | 0.0015 | 0.559 | — | — | — |
| 38 | $C_{10}DPO(SO_3Na)_1$[8] L,M- | 0.0100 | — | 0.235 | 0.267 | — |
| 39[2] | $C_{10}DPO(SO_3Na)_1$[8] L,M- | 0.0005 | 0.011 | — | — | — |
| 40[2] | $C_{10}DPO(SO_3Na)_2$[9] L,M- | 0.0010 | 0.21 | — | — | — |
| 41[2] | $C_{10}DPO(SO_3Na)_2$[9] L,M- | 0.0015 | 0.041 | — | — | — |
| 42[2] | $C_{10}DPO(SO_3Na)_2$[9] L,M- | 0.0100 | — | 0.005 | 0.005 | — |

TABLE IX-continued

| Run | Collector | Dosage (kg/kg) | Rutile Recovery | Apatite Recovery | Pyrolusite Recovery | Diaspore Recovery |
|---|---|---|---|---|---|---|
| | $C_{10}DPO(SO_3Na)_2$[9] | | | | | |
| 43 | L,D-$C_{16}DPO(SO_3Na)_1$[10] | 0.0100 | 0.744 | — | 0.889 | — |
| 44[2] | L,D-$C_{16}DPO(SO_3Na)_2$[11] | 0.0100 | 0.289 | — | 0.522 | — |
| 45 | L,M-$C_{16}DPO(SO_3Na)_1$[12] | 0.0100 | 0.185 | — | 0.348 | — |
| 46[2] | L,M-$C_{16}DPO(SO_3Na)_2$[13] | 0.0100 | 0.109 | — | 0.176 | — |
| 47 | L,D-$C_{12}DPO(SO_3Na)_1$[14] | 0.0100 | — | — | 0.733 | — |
| 48[2] | L,D-$C_{12}DPO(SO_3Na)_2$[15] | 0.0100 | — | — | 0.337 | — |

[1]Branched $C_{12}$ dialkylated sodium diphenyl oxide monosulfonate.
[2]Not an embodiment of the invention.
[3]Branched $C_{12}$ dialkylated sodium diphenyl oxide disulfonate.
[4]Branched $C_{12}$ monoalkylated sodium diphenyl oxide monosulfonate.
[5]Branched $C_{12}$ monoalkylated sodium diphenyl oxide disulfonate.
[6]Linear $C_{10}$ dialkylated sodium diphenyl oxide monosulfonate.
[7]Linear $C_{10}$ dialkylated sodium diphenyl oxide disulfonate.
[8]Linear $C_{10}$ monoalkylated sodium diphenyl oxide monosulfonate.
[9]Linear $C_{10}$ monoalkylated sodium diphenyl oxide disulfonate.
[10]Linear $C_{16}$ dialkylated sodium diphenyl oxide monosulfonate.
[11]Linear $C_{16}$ dialkylated sodium diphenyl oxide disulfonate.
[12]Linear $C_{16}$ monoalkylated sodium diphenyl oxide monosulfonate.
[13]Linear $C_{16}$ monoalkylated sodium diphenyl oxide disulfonate.
[14]Linear $C_{12}$ dialkylated sodium diphenyl oxide monosulfonate.
[15]Linear $C_{12}$ dialkylated sodium diphenyl oxide disulfonate.

The data in Table IX above demonstrates that the monosulfonated collector used in the process of the present invention consistently obtains higher recoveries of a variety of minerals when compared to collectors that are similar other than for the monosulfonation.

EXAMPLE 10

Sequential Flotation

This example uses the Hallimond tube flotation procedure outlined in Example 1. In each case the feed material is a 50/50 percent by weight blend of the components listed in Table X below. The specific collectors used and the mineral recoveries obtained are also listed in Table X below.

The data in the above table demonstrates that various minerals subject to flotation in the process of the present invention may be effectively separated by the control of collector dosage. For example, while apatite and dolomite can both be floated by the process of this invention, it is clear that apatite floats more readily at lower collector dosages than does dolomite. Thus, the apatite can be floated at a first stage, low dosage float. This can be followed by subsequent flotation at higher collector dosages to float the dolomite. As an examination of the other runs in this example demonstrate, similar separations are possible using other minerals.

TABLE X

| Collector | Dosage (kg/kg) | Mineral Blend Component #1 | Mineral Blend Component #2 | Mineral Recovery Component #1 | Mineral Recovery Component #2 |
|---|---|---|---|---|---|
| L,D-$C_{10}DPO(SO_3Na)_1$[1] | 0.025 | Apatite | Hematite | 0.614 | 0.068 |
| L,D-$C_{10}DPO(SO_3Na)_1$[1] | 0.100 | Apatite | Hematite | 0.947 | 0.489 |
| L,D-$C_{10}DPO(SO_3Na)_1$[1] | 0.025 | Apatite | Dolomite | 0.726 | 0.182 |
| L,D-$C_{10}DPO(SO_3Na)_1$[1] | 0.100 | Apatite | Dolomite | 0.998 | 0.670 |
| B,D-$C_{12}DPO(SO_3Na)_1$[2] | 0.025 | Apatite | Martite | 0.873 | 0.097 |
| B,D-$C_{12}DPO(SO_3Na)_1$[2] | 0.100 | Apatite | Martite | 0.944 | 0.335 |
| B,D-$C_{12}DPO(SO_3Na)_1$[2] | 0.025 | Apatite | Bauxite | 0.604 | 0.367 |
| B,D-$C_{12}DPO(SO_3Na)_1$[2] | 0.100 | Apatite | Bauxite | 0.889 | 0.603 |
| B,D-$C_{12}DPO(SO_3Na)_1$[2] | 0.025 | Rutile | Martite | 0.893 | 0.223 |
| B,D-$C_{12}DPO(SO_3Na)_1$[2] | 0.100 | Rutile | Martite | 0.947 | 0.366 |
| B,D-$C_{12}DPO(SO_3Na)_1$[2] | 0.025 | Rutile | Bauxite | 0.801 | 0.229 |
| B,D-$C_{12}DPO(SO_3Na)_1$[2] | 0.100 | Rutile | Bauxite | 0.914 | 0.377 |
| B,D-$C_{12}DPO(SO_3Na)_1$[2] | 0.025 | Gibbsite | Boehmite | 0.881 | 0.137 |
| B,D-$C_{12}DPO(SO_3Na)_1$[2] | 0.100 | Gibbsite | Boehmite | 0.947 | 0.229 |
| L,D-$C_{10}DPO(SO_3Na)_1$[1] | 0.025 | Gibbsite | Boehmite | 0.850 | 0.111 |
| L,D-$C_{10}DPO(SO_3Na)_1$[1] | 0.100 | Gibbsite | Boehmite | 0.894 | 0.203 |
| L,D-$C_{10}DPO(SO_3Na)_1$[1] | 0.025 | Pyrolusite | Hematite | 0.717 | 0.188 |
| L,D-$C_{10}DPO(SO_3Na)_1$[1] | 0.100 | Pyrolusite | Hematite | 0.915 | 0.404 |
| B,D-$C_{12}DPO(SO_3Na)_1$[2] | 0.025 | Topaz | Cassiterite | 0.791 | 0.103 |
| B,D-$C_{12}DPO(SO_3Na)_1$[2] | 0.100 | Topaz | Cassiterite | 0.956 | 0.458 |
| B,D-$C_{12}DPO(SO_3Na)_1$[2] | 0.025 | Rutile | Kaolin | 0.611 | 0.309 |
| B,D-$C_{12}DPO(SO_3Na)_1$[2] | 0.100 | Rutile | Kaolin | 0.804 | 0.518 |

[1]Linear $C_{10}$ dialkylated sodium diphenyl oxide monosulfonate.
[2]Branched $C_{12}$ dialkylated sodium diphenyl oxide monosulfonate.

EXAMPLE 11

Separation of Apatite from Silica and Dolomite

The procedure outlined in Example 4 is followed with the exception that the samples include 30 percent apatite, 60 percent silica and 10 percent dolomite. Additionally, a refined hydrocarbon is added in Runs 2 and 3. The results obtained are shown in Table XI below.

TABLE XI

| Run | Collector | Dosage (kg/ metric ton) | P Recovery | P Grade | Mg Recovery | Mg Grade |
|---|---|---|---|---|---|---|
| 1 | L,D-$C_{10}DPO(SO_3Na)_1$[2] | 0.050 | 0.862 | 0.114 | 0.391 | 0.048 |
| 2 | L,D-$C_{10}DPO(SO_3Na)_1$[2] | 0.050 | | | | |
| | Rifined kerosene[3] | 0.050 | 0.827 | 0.125 | 0.320 | 0.042 |
| 3 | L,D-$C_{10}DPO(SO_3Na)_1$[2] | 0.050 | | | | |
| | Refined kerosene[3] | 0.010 | 0.817 | 0.135 | 0.302 | 0.040 |
| 4[1] | Oleic Acid | 0.050 | | | | |
| | Refined kerosene[3] | 0.010 | 0.778 | 0.107 | 0.563 | 0.061 |

[1]Not an embodiment of the invention.
[2]A linear $C_{10}$ dialkylated sodium diphenyl oxide monosulfonate.
[3]A refined kerosene product available commercially from Phillips Petroleum as Soltrol TM brand kerosene. It is added simultaneously with the collector to the flotation cell.

The data in the above table demonstrates the ability of the collector of the present invention to float apatite preferably over dolomite or to separate apatite and dolomite. The industry standard shown in Run 4 does not obtain comparable separation of apatite and dolomite thus resulting in recovery of phosphorus significantly contaminated with magnesium. The addition of the hydrocarbon in the process of the present invention results in a slightly decreased recovery of higher grade phosphorus while decreasing the amount of magnesium collected.

EXAMPLE 12

Flotation of Apatite

15 The procedure followed in Example 11 is followed with the exception that the ore floated is a mixture of 30 percent apatite, 10 percent calcite and 60 percent silica. The results obtained are shown in Table XII below.

TABLE XII

| Run | Collector | Dosage (kg/ metric ton) | P Recovery | P Grade |
|---|---|---|---|---|
| 1 | L,D-$C_{10}DPO(SO_3Na)_1$[1] | 0.050 | 0.317 | 0.128 |
| 2 | L,D-$C_{10}DPO(SO_3Na)_1$[1] | 0.100 | 0.792 | 0.137 |
| 3[2] | Oleic Acid | 0.100 | 0.551 | 0.064 |

[1]A linear $C_{10}$ dialkylated sodium diphenyl oxide monosulfonate.
[2]Not an embodiment of the invention.

The data in Table XII above demonstrates the effectiveness of the present invention in the recovery of apatite. When compared to Example 11, it also shows that the dosage needed to obtain a particular recovery is affected by the particular minerals being subjected to flotation.

EXAMPLE 13

Flotation of Carbon Based Inks

Five slurries are prepared by, in each case, pulping 240 g of printed paper (70 weight percent newsprint and 30 weight percent magazine): 1.61 g of diethylenetriaminepentaacetic acid, a color control agent; 10.65 g sodium silicate: the amount of the collector specified in Table XIII; and 5.64 g hydrogen peroxide with sufficient water to result in a slurry which is two weight percent solids. The slurry pH is 10.5, except as indicated and the temperature is 45° C. Pulping is carried out for 30 minutes. Each slurry is prepared from copies of exactly the same pages to assure that the amount of ink is comparable in each of the five slurries prepared.

The pulped slurry is transferred to a 15 liter Voith Flotation Cell with sufficient water of dilution to completely fill the cell. Sufficient calcium chloride is added to the pulp to give a water hardness of 180 parts per million $CaCO_3$. Flotation is initiated by the introduction of air bubbles passing through the highly agitated pulp and is continued for a period of 10 minutes. Froth is then removed by standard hand paddling to produce the flotation product.

The flotation product is then filtered and dried. The flotation cell contents containing the cellulose fibers are also filtered and dried. The flotation product is analyzed by colorimetry using a graded composition scale of 0 to 10 with 0 being all white and 10 being all black. The cellulose fiber mats prepared from the cell contents are examined using a high power microscope to observe the ink particles left per unit area.

The data obtained is presented in Table XIII below. Conditions in each run are identical except as noted.

TABLE XIII

| Run | Collector | Dosage (g) | pH of Flotation | Ink Conc. - Scale Reading | Ink Conc. - Visual | Cellulose Mat Rating |
|---|---|---|---|---|---|---|
| 1[1] | Oleic Acid | 5.5 | 10.5 | 4 | Light Grey | — |
| 2 | L,D-$C_{10}DPO(SO_3Na)_1$[2] | 2.0 | 10.5 | 5 | Grey | No change |
| 3 | L,D-$C_{10}DPO(SO_3Na)_1$[2] | 2.0 | 8.0[3] | 6 | Dark Grey | 25% decrease |
| 4[4] | L,D-$C_{10}DPO(SO_3Na)_1$[2] | 2.0 | 10.5 | 8 | Very Dark Grey | 50% decrease |
| 5[4] | L,D-$C_{10}DPO(SO_3Na)_1$[2] | 2.0 | 8.0[3] | 9 | Light | 75% |

TABLE XIII-continued

| Run | Collector | Dosage (g) | pH of Flotation | Ink Conc. - Scale Reading | Ink Conc. - Visual | Cellulose Mat Rating |
|---|---|---|---|---|---|---|
| | | | | | Black | decrease |

[1]Not an embodiment of the invention; current industry standard.
[2]A linear $C_{10}$ dialkylated sodium diphenyl oxide monosulfonate.
[3]pH is flotation cell reduced by addition of 1N HCl.
[4]No $CaCl_2$ added to float cell in this run.

The data in the above table demonstrates that the process of the present invention is effective in the separation of graphite ink and other carbon based inks from paper in the de-inking of recycled paper by flotation. Runs 2–5, when compared to Run 1 which approximates current industry standard, show that the use of the collectors of the present invention result in a greater recovery of ink at a significantly lower collector dosage.

What is claimed is:

1. A process for the recovery of minerals by froth flotation comprising subjecting an aqueous slurry comprising particulate minerals selected from the group consisting of oxide ores, sulfide ores, noble metal ores, graphite inks and mixtures thereof to froth flotation in the presence of a collector comprising an alkylated diaryl oxide sulfonic acid or salt thereof and mixtures of such acids or salts wherein at least about 20 percent of the sulfonic acid or salts thereof are monosulfonated under conditions such that the minerals to be recovered are floated and the floated minerals are recovered.

2. The process of claim 1 wherein the particulate minerals consists of oxide ore and wherein the oxide ore is selected from the group consisting of copper oxide, iron oxide, nickel oxide phosphorus oxide, aluminum oxide and titanium oxide ores.

3. The process of claim 1 wherein the particulate minerals are selected from the group consisting of oxide ores, sulfide ores and mixtures thereof.

4. The process of claim 1 wherein the monosulfonic acid or salt thereof corresponds to the formula:

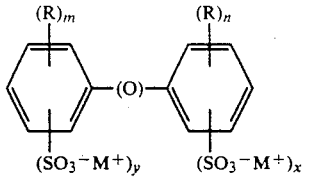

wherein each R is independently a saturated or unsaturated alkyl or substituted alkyl radical; each m and n is independently 0, 1 or 2; each M is independently hydrogen, an alkali metal, alkaline earth metal, ammonium or substituted ammonium and each x and y are individually 0 or 1 with the proviso that the sum of x and y is 1.

5. The process of claim 4 wherein R is an alkyl group having from 1 to 24 carbon atoms.

6. The process of claim 4 wherein R is an alkyl group having from 6 to 24 carbon atoms.

7. The process of claim 6 wherein R is an alkyl group having from 10 to about 16 carbon atoms.

8. The process of claim 4 wherein R is a linear or branched alkyl group.

9. The process of claim 4 wherein the sum of m and n is two.

10. The process of claim 1 wherein the process is conducted at the natural pH of the slurry.

11. The process of claim 1 wherein the flotation is conducted at a pH lower than the natural pH of the slurry.

12. The process of claim 1 wherein the flotation is conducted at a pH higher than the natural pH of the slurry.

13. The process of claim 1 wherein the total concentration of the collector is at least about 0.001 kg/metric tone and no greater than about 5.0 kg/metric ton.

14. The process of claim 1 wherein the collector is added to the slurry in at least about two stages and no more than about six stages.

15. The process of claim 1 wherein at least about 25 percent of the sulfonic acid or salt is monosulfonated.

16. The process of claim 1 wherein at least about 40 percent of the sulfonic acid or salt is monosulfonated.

17. The process of claim 1 wherein at least about 50 percent of the sulfonic acid or salt is monosulfonated.

18. The process of claim 1 wherein the recovered mineral comprises graphite and the aqueous slurry further comprises pulped paper.

* * * * *